US010539364B2

(12) United States Patent
Repasky

(10) Patent No.: US 10,539,364 B2
(45) Date of Patent: Jan. 21, 2020

(54) HYDROCARBON DISTILLATION

(71) Applicant: General Electric Company, Schenectady, NY (US)

(72) Inventor: John Michael Repasky, Schertz, TX (US)

(73) Assignee: General Electric Company, Schenectady, NY (US)

( * ) Notice: Subject to any disclaimer, the term of this patent is extended or adjusted under 35 U.S.C. 154(b) by 260 days.

(21) Appl. No.: 15/457,548

(22) Filed: Mar. 13, 2017

(65) Prior Publication Data

US 2018/0259250 A1 Sep. 13, 2018

(51) Int. Cl.

| | |
|---|---|
| ***F25J 1/02*** | (2006.01) |
| ***F25J 1/00*** | (2006.01) |
| ***F25J 3/00*** | (2006.01) |
| ***F25J 3/02*** | (2006.01) |

(52) U.S. Cl.

CPC ..... *F25J 1/0238* (2013.01); *F25J 1/0022* (2013.01); *F25J 1/023* (2013.01); *F25J 1/0212* (2013.01); *F25J 3/0247* (2013.01); *F25J 2220/64* (2013.01); *F25J 2230/04* (2013.01)

(58) Field of Classification Search

CPC ..... F25J 1/0238; F25J 1/0022; F25J 1/0052; F25J 1/0212; F25J 1/023; F25J 3/0209; F25J 3/0233; F25J 3/0238; F25J 3/0242; F25J 1/0009; F25J 2260/60; F25J 2230/04; F25J 2220/64; F25J 2260/20; F25J 2230/30; F25J 2200/02; F25J 2200/40

USPC ..... 62/620–628, 611–613

See application file for complete search history.

(56) References Cited

U.S. PATENT DOCUMENTS

| | | | | |
|---|---|---|---|---|
| 3,857,251 | A * | 12/1974 | Alleaume | F17C 9/04 62/47.1 |
| 6,526,777 | B1 * | 3/2003 | Campbell | F25J 1/0201 62/621 |
| 2004/0079107 | A1 * | 4/2004 | Wilkinson | F25J 1/0239 62/611 |
| 2004/0177646 | A1 * | 9/2004 | Wilkinson | F25J 1/0201 62/614 |
| 2006/0242969 | A1 * | 11/2006 | Minton | F17C 9/04 62/50.2 |
| 2009/0064713 | A1 * | 3/2009 | Buijs | F25J 1/0022 62/613 |
| 2009/0166170 | A1 * | 7/2009 | Sun | B01D 1/0041 202/161 |
| 2009/0277218 | A1 * | 11/2009 | Kevenaar | F25J 1/0022 62/612 |
| 2010/0024477 | A1 * | 2/2010 | Roberts | F25J 1/0022 62/620 |

(Continued)

*Primary Examiner* — Melvin Jones

(74) *Attorney, Agent, or Firm* — Mintz Levin Cohn Ferris Glovsky and Popeo, P.C.

(57) ABSTRACT

Systems and methods are provided for increasing the efficiency of liquefied natural gas production and heavy hydrocarbon distillation. In one embodiment, air within an LNG production facility can be utilized as a heat source to provide heat to HHC liquid for distillation in a HHC distillation system. The mechanism of heat transfer from the air can be natural convection. In another embodiment, heat provided by natural gas, or compressed natural gas, can be used for HHC distillation. In other embodiments, various other liquids can be used to transfer heat to HHC liquid for distillation.

13 Claims, 7 Drawing Sheets

(56) References Cited

U.S. PATENT DOCUMENTS

| | | | | |
|---|---|---|---|---|
| 2010/0031700 | A1* | 2/2010 | Wilkinson | F25J 1/0022 62/620 |
| 2012/0085126 | A1* | 4/2012 | Gupta | B01D 1/28 62/617 |
| 2012/0204599 | A1* | 8/2012 | Northrop | C10L 3/10 62/617 |
| 2014/0150493 | A1* | 6/2014 | Furlong | B01D 53/263 62/617 |
| 2015/0308737 | A1* | 10/2015 | Chen | F25J 3/061 62/623 |
| 2015/0362251 | A1* | 12/2015 | Oelfke | B01D 3/166 62/637 |

* cited by examiner

HYDROCARBON DISTILLATION

FIELD

Hydrocarbon distillation methods, systems and processes are provided, and in particular systems and methods are provided for increasing the efficiency of liquefied natural gas production and hydrocarbon distillation.

BACKGROUND

Liquefied natural gas, referred to in abbreviated form as "LNG," is a natural gas which has been cooled to a temperature of approximately −162° C. (−260° F.) and typically stored at a pressure of up to approximately 25 kPa (4 psig), and has thereby taken on a liquid state. Natural gas (NG) is primarily composed of methane, but can include ethane, propane, and heavy hydrocarbon components such as butanes, pentanes, hexanes, benzene, toluene, ethylbenzene, and xylenes. Many natural gas sources are located a significant distance away from the end-consumers. One cost-effective method of transporting natural gas over long distances is to liquefy the natural gas and to transport it in tanker ships, also known as LNG-tankers. The LNG is transformed back into gaseous natural gas at the destination.

In a typical liquefaction process a compressor is used to deliver pressurized mixed refrigerant (MR) to a cold box, which in turn is used to cool a feedstock, such as a natural gas, to form a liquefied gas. The heavy hydrocarbon components in NG will condense and freeze at higher temperatures than the lighter components. Therefore, it can be beneficial to remove heavy hydrocarbon liquid components from the NG during liquefaction. The heavy hydrocarbon liquid components can be put through a distillation process to separate the individual heavy hydrocarbon components. Accordingly, there is a need to efficiently supply heat to the distillation system to distill the heavy hydrocarbon liquid.

SUMMARY

Systems and methods for producing liquefied natural gas (LNG) and separating heavy hydrocarbon components are provided. In one embodiment, a system is provided having an LNG production facility configured to receive and liquefy a natural gas feedstock. The LNG production facility can have a refrigerant fluid configured to accept heat from the natural gas feedstock. The system can also include a distillation column coupled to the LNG production facility. The distillation system can have a first heat exchanger configured to transfer heat to a liquid containing heavy hydrocarbon components such that the liquid boils to form vapor thereby allowing the heavy hydrocarbon components to be separated and collected. The heat can be transferred from at least one of a heated fluid comprising at least a portion of at least one of the natural gas feedstock, the refrigerant fluid, and an ambient air.

The system can vary in many ways. For example, the system can be configured such that the heat being transferred from the heated fluid is delivered to the first heat exchanger from a second heat exchanger. Furthermore, the first and second heat exchangers can be connected by at least one downcomer and at least one riser. The at least one downcomer and/or the at least one riser can include a valve that can be used to control the amount of heat transferred to the liquid containing heavy hydrocarbon components.

In one embodiment, heat can be transferred from the heated fluid by natural convection. In some embodiments, heat can be transferred from the heated fluid by forced convection. As another example, the system can include heat pipes that can be configured to aid in transferring heat from the heated fluid to the liquid. As yet another example, the first heat exchanger can be a reboiler.

In another aspect, a method for separating heavy hydrocarbon components is provided. The method can include delivering a fluid in an LNG production facility to a first heat exchanger coupled to a distillation column that contains a liquid containing heavy hydrocarbon components, transferring heat from the fluid to the liquid such that the liquid boils to form a vapor containing heavy hydrocarbon components, extracting heat from the vapor such that desired heavy hydrocarbon components condense to form a distilled heavy hydrocarbon liquid, and collecting the condensed distilled heavy hydrocarbon liquid.

The method can vary in many ways. For example, the fluid can be natural gas (NG) feedstock that is used to produce LNG. In some embodiments, the heat can be transferred from a NG feedstock to the fluid via a second heat exchanger that can be thermally coupled to the first heat exchanger. In other embodiments, the heat can be transferred from a refrigerant to the fluid, where the refrigerant can have received heat from an NG feedstock. As another example, a refrigerant can be heated during compression and heat can be transferred from the refrigerant to the fluid after compression.

In other aspects, the fluid can be ambient air. The heat can transferred from the air via natural convection. Alternatively, the heat can be transferred from the air via forced convection.

In other embodiments, the heat can be transferred from air in the LNG production facility to the fluid via a second heat exchanger that can be thermally coupled to the first heat exchanger. Furthermore, the heat can be transferred from the air via natural convection. Alternatively, the heat can be transferred from the air via forced convection.

DETAILED DESCRIPTION

Certain exemplary embodiments will now be described to provide an overall understanding of the principles of the structure, function, manufacture, and use of the systems, devices, and methods disclosed herein. One or more examples of these embodiments are illustrated in the accompanying drawings. Those skilled in the art will understand that the systems, devices, and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention. Further, in the present disclosure, like-named components of the embodiments generally have similar features, and thus within a particular embodiment each feature of each like-named component is not necessarily fully elaborated upon.

Natural gas can often contain heavy hydrocarbon (HHC) components such as, butanes, pentanes, hexanes, benzene, toluene, ethylbenzene, and xylenes. In order to prevent HHCs from freezing during the production of LNG, a liquid containing at least a portion of the HHCs (HHC liquid) can be removed from the natural gas. The HHC liquid can be distilled, for example to produce essentially pure components, fuels, liquefied petroleum gas (LPG) or natural gas liquids (NGLs). Current practices for distilling HHC liquid use oil or steam to provide heat to the distillation system. While oil or steam can be effective, the use of current heat sources present in an LNG production system can be less costly and more efficient. In certain exemplary embodiments, a natural gas feedstock, a refrigerant, and/or air present in an LNG production system can be utilized to heat a distillation system.

Figure 1:
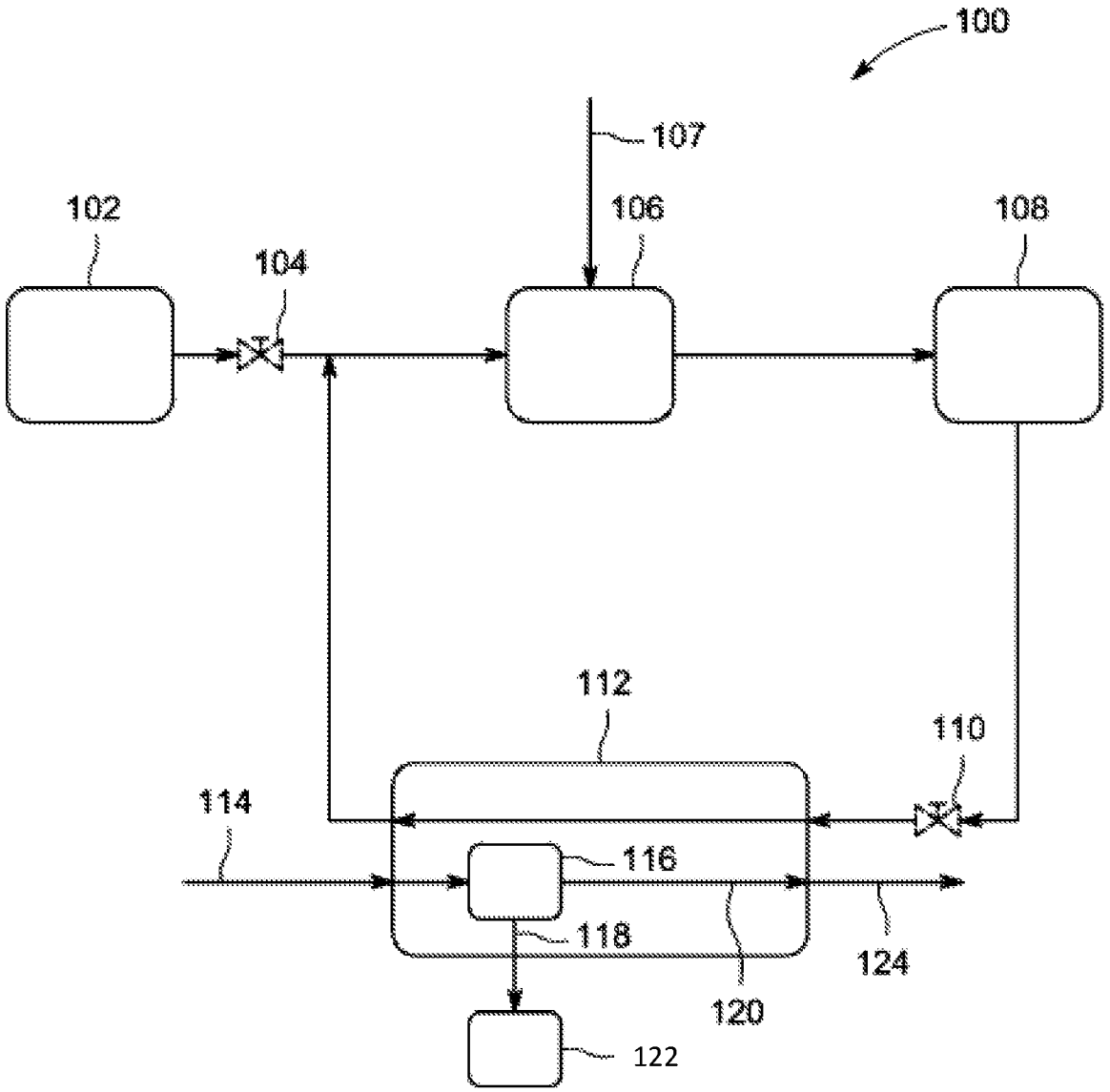
FIG. 1 is a diagram of one embodiment of an LNG liquefaction system.

FIG. 1 is a diagram showing one embodiment of an LNG liquefaction system 100 of an LNG production facility. The liquefaction system 100 can include a refrigerant supply system 102 that can introduce a mixed refrigerant (MR), via a valve 104, to the liquefaction system 100. Initially, low-pressure, low-temperature MR vapor can be delivered to a compression system 106. The compression system 106 can be, e.g., a multistage compression system having multiple compressors in series. The compressors can be driven by electric motors that can receive electric power 107 from an external power source. When the MR leaves the compression system 106, it can be in a high-temperature, high-pressure, vapor state. The MR can subsequently flow to condensers/aftercoolers 108 that are downstream of the compression system 106. Alternatively and/or additionally, condensers, intercoolers, or air coolers can be located between stages of the compressors of the compression system 106. The condensers/intercoolers/aftercoolers, or other heat exchanger, 108 can facilitate a phase change of the MR from vapor, or mostly vapor, to a predominantly liquid state by removing excess heat generated during the compression process. Once at least a portion of the MR is in a condensed state it can travel through an expansion valve 110, which can create a pressure drop that can put at least a portion of the MR in a low-pressure, low-temperature, liquid state. The liquid MR can be then delivered to a heat exchanger 112 to cool incoming natural gas (NG) feedstock 114. The heat exchanger 112 can be, e.g., a core plate and fin style heat exchanger. Alternatively, other heat exchangers (i.e. core, etched plate, diffusion bonded, wound coil, shell and tube, plate-and-frame) can be used. It is noted that one skilled in the art will have a basic understanding of how heat exchangers work, and will know that refrigerants can travel through cooling passages, cooling elements, or within a shell, to provide refrigeration to a "hot fluid" such as NG feedstock. As the NG and MR travel through the heat exchanger 112, heat can be transferred from the NG feedstock 114 to the MR such that the NG 114 begins to condense.

NG feedstock 114 can often contain heavy hydrocarbon components (HHCs) such as butanes, pentanes, hexanes, benzene, toluene, ethylbenzene, and xylenes. It can be desirable to remove HHCs during production to prevent them from freezing at typical LNG production temperatures. As illustrated in FIG. 1, the heat exchanger 112 can include a HHC separation system 116 that can facilitate removal of HHCs. As the NG feedstock 114 is cooled within the heat exchanger, HHCs can condense at higher temperatures than lighter molecules, e.g., methane. Therefore, liquid 118 containing primarily HHCs can be separated from the remaining NG vapor 120 within the HHC separation system 116, and it can be stored in a HHC storage vessel 122. The remaining NG vapor can continue through the heat exchanger and condense to form LNG 124. The LNG 124 can then be let down in pressure, and stored in a storage vessel (not shown). The MR that leaves the heat exchanger can be predominantly a vapor, and it can travel to the compression system 106 to continue the cycle. It is noted that the diagram illustrated in FIG. 1 is not intended to describe the geometry of the liquefaction system, or any of the components within the liquefaction system.

Separation and/or purification of heavy hydrocarbon components can be achieved through flash separation and/or distillation. For example, in some cases, the HHC liquid can be put through a multistage distillation process to separate it into its constituent components (distilled HHC liquid). As a result, essentially pure components, fuels, liquefied petroleum gas (LPG) or natural gas liquids (NGLs), and/or other hydrocarbon components can be coproduced with LNG.

A HHC distillation column can include a reboiler, and may include one or more condensers to selectively condense heavy hydrocarbon components. An exemplary HHC distillation column can operate at temperatures between about −150° F. and about 0° F., and at pressures between about 100 psia and about 1000 psia. In certain exemplary embodiments, the HHC distillation column can operate at temperatures between about −120° F. and about −50° F., and at pressures between about 400 psia and about 800 psia.

Figure 2:
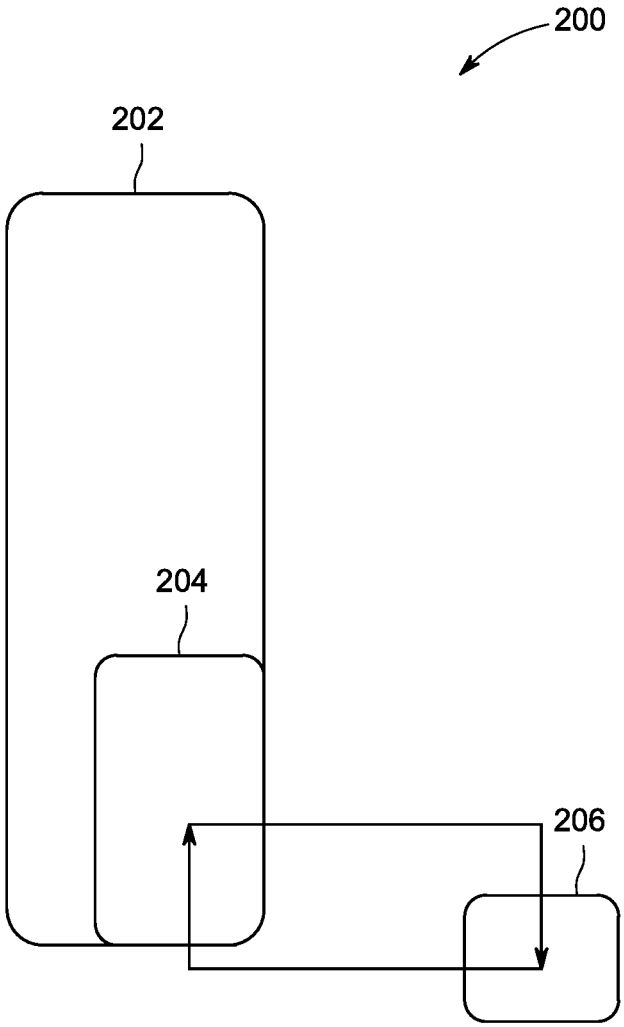
FIG. 2 is a diagram of one embodiment of a HHC distillation system.

FIG. 2 illustrates one embodiment of a distillation system 200 that can be used to distill HHC liquid. The system can include a distillation column 202 that can have HHC liquid within it, a HHC distillation reboiler 204 which can be used to transfer heat to the HHC liquid, and a heating system 206 that can supply heat to the reboiler. The heating system 206 can provide heat to the reboiler 204 using a heated fluid, as will be discussed in more detail below. The fluid can be heated in the heating system 206 and circulated between the reboiler 204 and the heating system 206. As the heated fluid flows through the reboiler 204, heat can be transferred from the heated fluid to the HHC liquid within the reboiler such that the HHC liquid boils to form a HHC vapor which can rise through the distillation column. The distillation column 202 can include one or more condensers (not shown) that enable simple distillation or fractional distillation. As the HHC vapor rises, the temperature of the vapor can decrease and certain HHC components can condense on the condensers and can be extracted from the distillation column. The remaining vapor can continue to rise throughout the column, where it can further cool, and other HHC components can condense and be extracted.

The heating system 206 can be used to provide heat to a number of systems and devices that can be used in an LNG production facility. For example, the heating system can provide heat to an amine system stripper reboiler, temperature swing adsorption drier beds for dehydration (for regeneration), as well as the HHC distillation reboiler 204 and other systems and devices. Depending on the configuration of a given LNG production facility, it can be desirable to implement a multipurpose heating system that can provide heat to multiple systems and devices within the LNG production facility. However, in some situations it can be desirable to implement purpose-specific heating systems. Purpose-specific heating systems can reduce capital cost and operating cost of the LNG production facility, simplify the design of the facility, reduce environmental emissions, and/or increase the energy efficiency of the facility.

Figure 3:
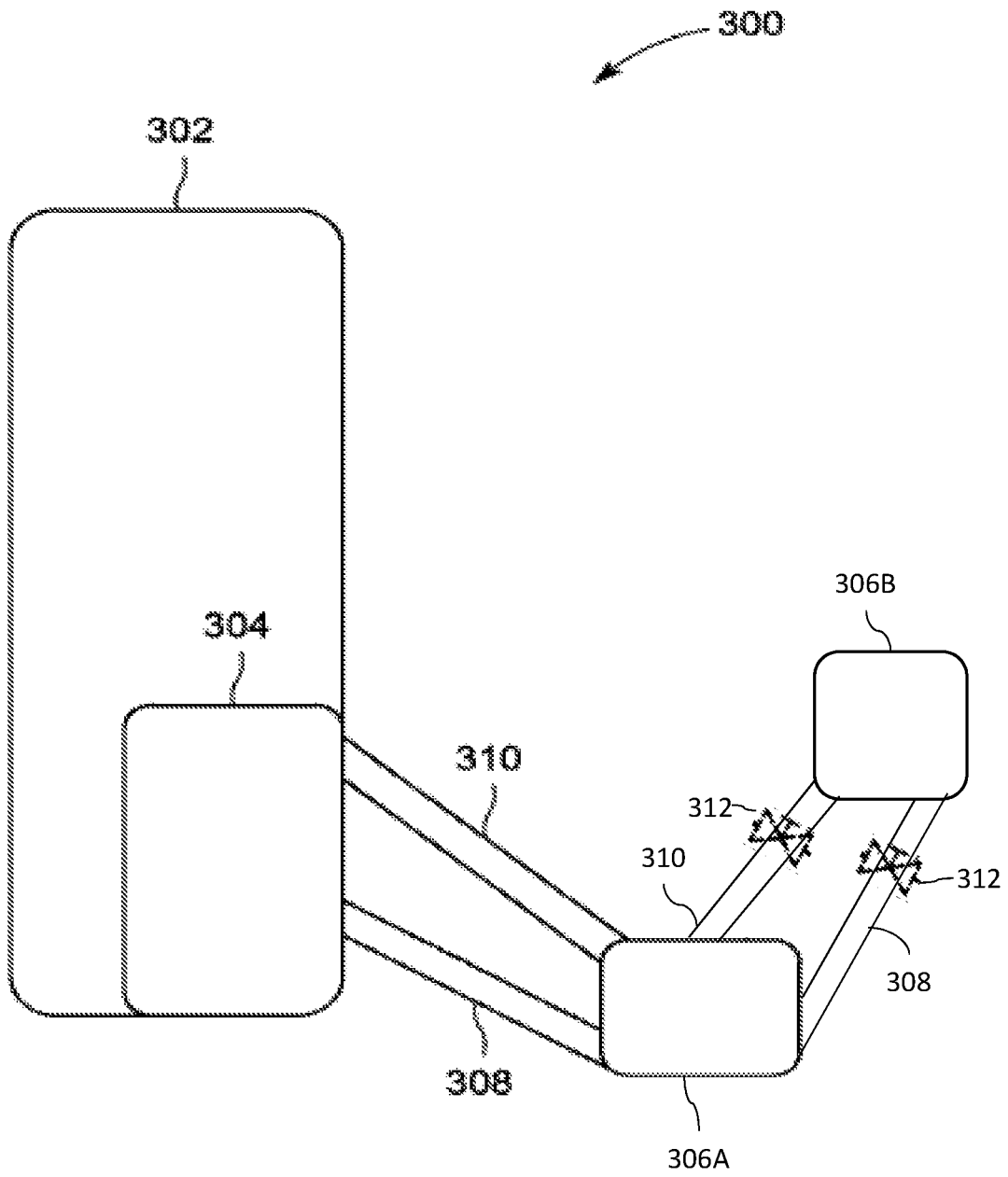
FIG. 3 is a diagram of another embodiment of a HHC distillation system.

As described above, an exemplary HHC distillation column can operate at temperatures between about −120° F. and about −50° F. Therefore, in one embodiment ambient air within an LNG production facility can be used as a heat source for a HHC distillation processes. FIG. 3 illustrates a distillation system 300 that can use ambient air as a heat source to distill HHC liquid. The system can include a distillation column 302 that can have HHC liquid within it, a HHC distillation reboiler 304 which can be used to transfer heat to the HHC liquid, and one or more heat exchangers 306. For example, the distillation column 302 can include a first heat exchanger 306A that can transfer heat from ambient air to the reboiler 304 and a second heat exchanger 306B. The heat being transferred from the heated fluid can be delivered to the first heat exchanger 306A from the second heat exchanger 306B. The first heat exchanger 306A can be coupled to the reboiler 304 by at least one downcomer 308 and at least one riser 310 that allow a refrigerant such as, e.g., a mixed refrigerant, propane, methane, fluorocarbons, ethylene, or ethane, to circulate between the reboiler 304 and the heat exchanger 306. The second heat exchanger 306B can also be coupled to the first heat exchanger 306A via a downcomer 308 and a riser 310. The downcomer 308 and the riser 310 can include a valve 312 that can control the amount of heat transferred to the liquid containing heavy hydrocarbon components.

Heat can be transferred from the air to the refrigerant via the heat exchanger 306, where the mechanism of heat transfer from the air can be natural convection. As heat is transferred to the refrigerant, the temperature of the refrigerant can increase, and at least a portion of the refrigerant can boil to form a vapor. The vapor can travel to the reboiler 304 via the riser 310, where it can transfer heat sufficient to boil a portion of the HHC liquid to form HHC vapor which can rise through distillation column. As the HHC vapor rises, it can be condensed and separated as described with regard to distillation system 200. As the refrigerant travels through the reboiler 304 it can cool and condense, and the condensed refrigerant liquid can travel back to the heat exchanger 306 via the downcomer 308. In certain aspects, the rate of heat transfer to the reboiler 304 can be controlled by a control valve on the downcomer 308 and/or on the riser 310. For example, the control valve can be used to control one or more temperatures and pressures within the distillation system 300.

Figure 4:
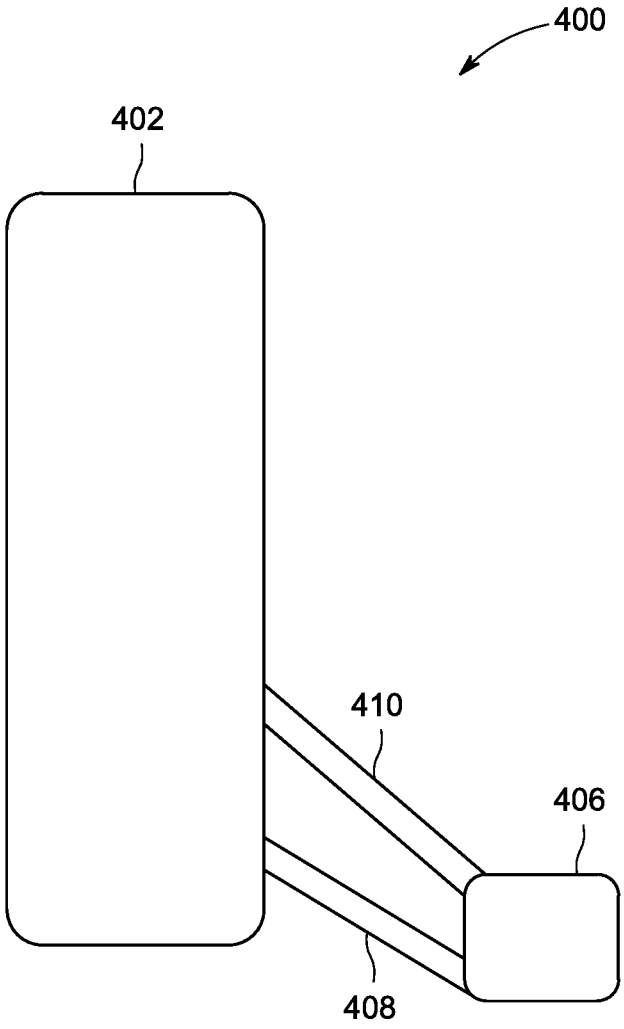
FIG. 4 is a diagram of another embodiment of a HHC distillation system.

In the distillation system 300 shown in FIG. 3, heat can be transferred to HHC liquid in the distillation column 302 via the reboiler 304. However, in some embodiments, a distillation system can be configured such that it does not include a reboiler, as shown in FIG. 4. The distillation system can include a distillation column 402 that can contain HHC liquid, and the distillation column 402 can be fluidly coupled to a heat exchanger 406 via a downcomer 408 and a riser 410. In this embodiment, HHC liquid can flow from the distillation column 402 to the heat exchanger 406 via the downcomer. The heat exchanger can facilitate heat transfer from ambient air within an LNG production facility to the HHC liquid within the heat exchanger. The mechanism of heat transfer from the air can be natural convection. As heat is transferred from the ambient air to the HHC liquid, the temperature of the HHC liquid can increase, and the HHC liquid can begin to boil, thus forming HHC vapor. HHC vapor can then travel from the heat exchanger 406 to the distillation column 402 via the riser 410. The HHC vapor can then rise through the distillation column and be condensed and separated as described with regard to distillation system 200. In certain aspects, the rate of heat transfer to the HHC liquid can be controlled by a control valve on the downcomer 408 and/or on the riser 410.

The distillation systems 300, 400 illustrated in FIGS. 3-4 do not require that a fluid is pumped between the distillation columns 302, 402 and the heat exchangers 306, 406. Additionally, since the heat source is ambient air, the systems 300, 400 do not require a fluid, such as hot oil (e.g. Dowtherm™) or steam, to be heated. Therefore, this configuration can eliminate the need for compressors, pumps, and fluid heating systems that would otherwise be used to provide heat to the HHC liquid for distillation. This can simplify the distillation system and reduce the operating cost and capital cost. Since power consumption has been reduced, any emissions associated with power consumption can also be reduced.

The distillation systems 300, 400 shown in FIGS. 3-4 can be modified in a number of ways. For example, the heat exchangers 306, 406 can include heat pipes that transfer heat from ambient air to fluid within the heat exchangers 306, 406. As another example, the distillation systems 300, 400 can include fans that blow air over the heat exchangers 306, 406 to ensure that the mechanism of heat transfer from the air is forced convection.

Figure 5:
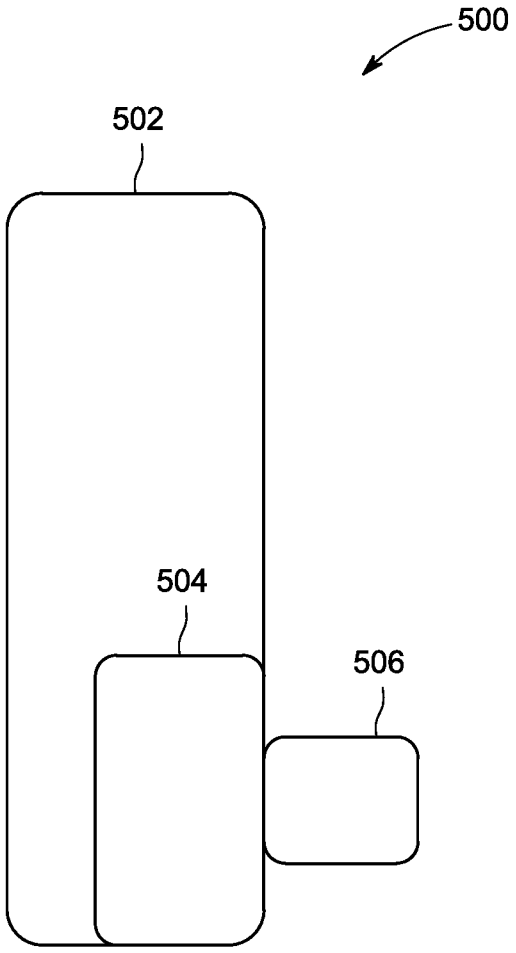
FIG. 5 is a diagram of another embodiment of a HHC distillation system.

In another embodiment, rather than using a heat exchanger such as heat exchangers 306, 406 described above, a forced convection boiler arrangement can be implemented to provide heat to HHC liquid within a distillation column. FIG. 5 shows a distillation system 500 that can include a distillation column 502, a reboiler 504, and a forced convection cooling system 506 that is fluidly coupled to the reboiler 504. The cooling system 506 can include fans that blow air into, or across, the reboiler 504 to facilitate heat transfer from ambient air within an LNG production facility to HHC liquid within the distillation column 502.

In another embodiment, NG feedstock can be used as a heat source for HHC distillation. For example, rather than air, NG feedstock can be used as a heat source in a distillation system that can generally be similar to distillation systems 300, 400, 500 illustrated in FIGS. 3-5. During the distillation process, the NG feedstock can be cooled as it provides heat for HHC distillation, which can reduce the amount of refrigeration required to convert the NG feedstock to LNG. After the NG feedstock passes through the distillation system, it can travel to a heat exchanger where it can be cooled to produce LNG, as described above with regard to FIG. 1.

Typically, during LNG production, NG feedstock can be compressed prior to being converted to LNG. The compression process can increase the temperature of the NG feed stock to about 149° C. (about 300F°). During or after compression, the compressed NG feedstock can be passed through intercoolers or aftercoolers to cool the NG feedstock prior to delivering it to a liquefaction system (see FIG. 1) where it can be converted to LNG. In another embodiment of a distillation system, compressed NG feedstock can be used to provide heat for HHC distillation. In this case, the higher temperature of the NG feedstock can result in significantly higher volumes of HHC distillation output, and/or it can facilitate using a smaller reboiler or heat exchanger within the distillation system. Additionally, the compressed NG feedstock can be cooled during the distillation process, which can reduce or eliminate the need to send it through intercoolers or aftercoolers prior to delivering it to a liquefaction system.

The increased temperature of compressed NG feedstock means that it can be suitable to provide heat for other applications that require higher heating temperatures. For example, compressed NG feedstock can provide heat to an amine system stripper reboiler, temperature swing adsorption drier beds for dehydration (for regeneration), water distillation systems, as well as a HHC distillation systems.

Figure 6:
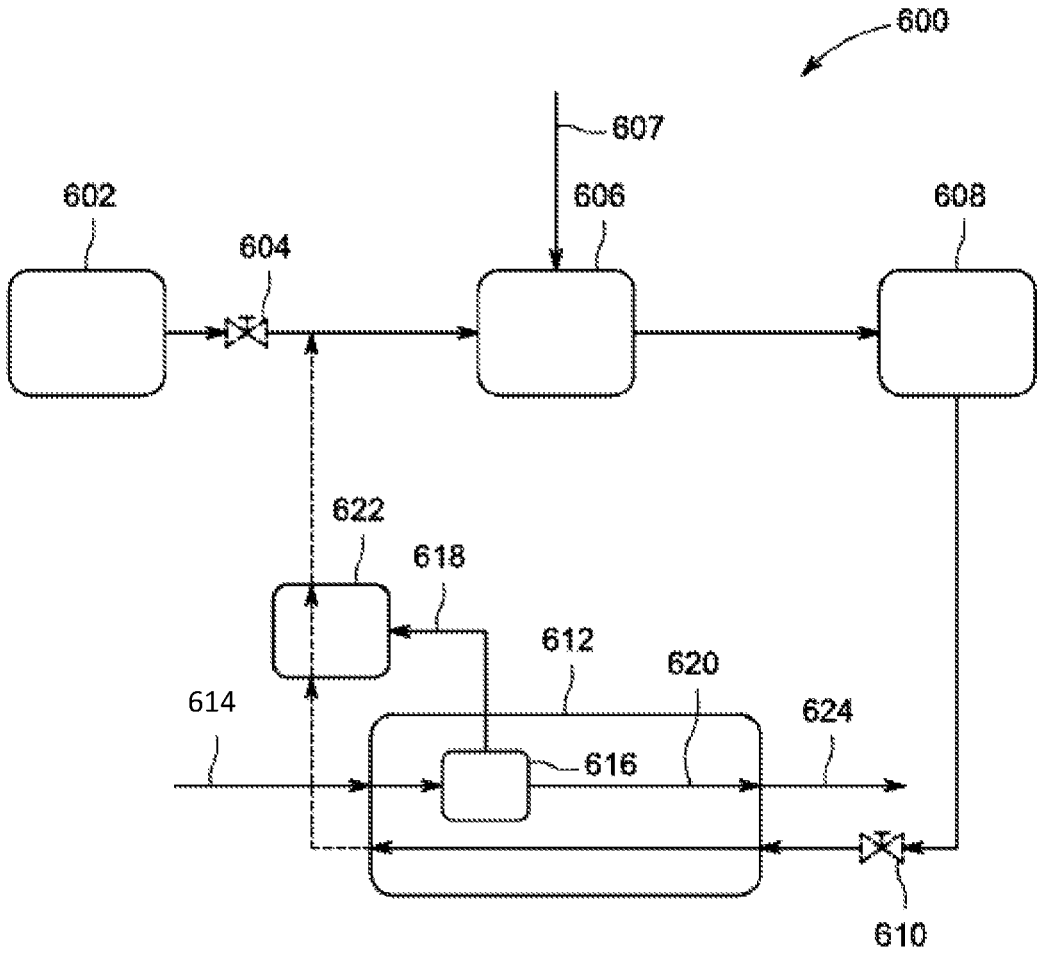
FIG. 6 is a diagram of one embodiment of an LNG liquefaction system that can include a HHC distillation system.

In another embodiment, refrigerant that flows through an LNG liquefaction system can be used as a heat source within a HHC distillation system. FIG. 6 shows a diagram of an LNG liquefaction system 600 of an LNG production facility, where a MR that flows through the liquefaction system 600 can be delivered to a HHC distillation system 622 to be used as a heat source for HHC distillation. The LNG liquefaction system 600 can generally be similar to the liquefaction system 100 described with regard to FIG. 1. Accordingly, the liquefaction system 600 can include a refrigerant supply system 602 that can introduce a mixed refrigerant (MR), via a valve 604, to the liquefaction system 600. Initially, low-pressure, low-temperature MR vapor is delivered to a compression system 606. As describe above, the compression system 606 can be, e.g., a multistage compression system having multiple compressors, and the compressors can, for example, be driven by electric motors that receive electric power 607 from an external power source. When the MR leaves the compression system 606, it can be in a high-temperature, high-pressure, vapor state. Subsequently, the MR can flow through condensers/aftercoolers 608 that are downstream of the compression system 606. Alternatively and/or additionally condensers, intercoolers, or air coolers can be located between stages of the compressors of the compression system 606. The condensers/intercoolers/aftercoolers, or other heat exchanger, 608 can facilitate a phase change of the MR from vapor, or mostly vapor, to a predominantly liquid state by removing excess heat generated during the compression process. Once the MR is in a condensed state it can travel through an expansion valve 610, which can create a pressure drop that can put the MR in a low-pressure, low-temperature, liquid state. The liquid MR can then be delivered to a heat exchanger 612 to cool incoming natural gas (NG) feedstock 614. The heat exchanger 612 can generally be similar to heat exchanger 112. As the NG and MR travel through the heat exchanger 612, heat can be transferred from the NG feedstock 614 to the MR such that the NG feedstock 614 begins to condense.

As described above, NG feedstock 614 can often contain heavy hydrocarbon components (HHCs), and it can be desirable to remove HHCs during liquefaction to prevent them from freezing at typical LNG production temperatures. As illustrated in FIG. 6, the heat exchanger 612 can include a HHC separation system 616 that can facilitate removal of HHC liquid. Therefore, liquid 618 containing primarily HHCs can be separated from the remaining NG vapor 620 within the HHC separation system 616, and stored in a HHC distillation system 622. The remaining NG vapor can continue through the heat exchanger and condense to form LNG 624. The LNG 624 can then be let down in pressure, and stored in a storage vessel (not shown).

The HHC distillation system 622 can generally be similar to the distillation facilities 300, 400, 500 described with regard to FIGS. 3-5. However, rather than using air or NG feedstock as a heat source, near-room-temperature MR that leaves the heat exchanger can be delivered to HHC distillation system to be used as a heat source for HHC distillation. As the MR provides heat for HHC distillation it can be cooled. The MR that leaves the distillation system can be delivered to the compression system 606 to continue the cycle.

Alternatively, the MR can be directly delivered to the HHC distillation system 622 prior to being delivered to the compression system 606. The utilization of the MR as a heat source can increase the efficiency of the compression process since the MR will be pre-cool prior to entering the compression system 606. Additionally, the load on the intercoolers, condensers, aftercoolers, or other heat exchangers, can be reduced, thereby allowing for smaller components to be used. As describe above, the compression system 606 can be, e.g., a multistage compression system having multiple compressors, where condensers, intercools, or air coolers can be located between stages of the compressors of the compression system 606. Rather than delivering the MR to the HHC distillation system 622 prior to compression, the MR can be delivered to the distillation system 622 between stages of compression. For example, the MR can travel through a first compressor, and can then be delivered to a distillation system to be used as a heat source for HHC distillation. The MR can then be delivered to a second compressor, and can continue through the system. In another embodiment, the MR can be delivered to a HHC distillation system once compression has been completed. Such configurations can reduce or eliminate the need for condensers, intercoolers, or aftercoolers that facilitate condensation of the compressed MR during or after compression.

Although the examples provided in FIGS. 3-6 describe using fluids that are directly involved with LNG production as heat sources for HHC distillation, other fluids can be used as well. For example, cooling water (CW), typically near ambient temperature, can be used as a heat source. Using cooling water to provide heat for HHC distillation can also offload cooling duty from a water cooling system, which can potentially increase the effectiveness of the water cooling system for selective or general use elsewhere in an LNG production facility. Other sources of water, e.g., river, sea, potable, etc., can also be available for use to provide heat for HHC distillation.

Figure 7:
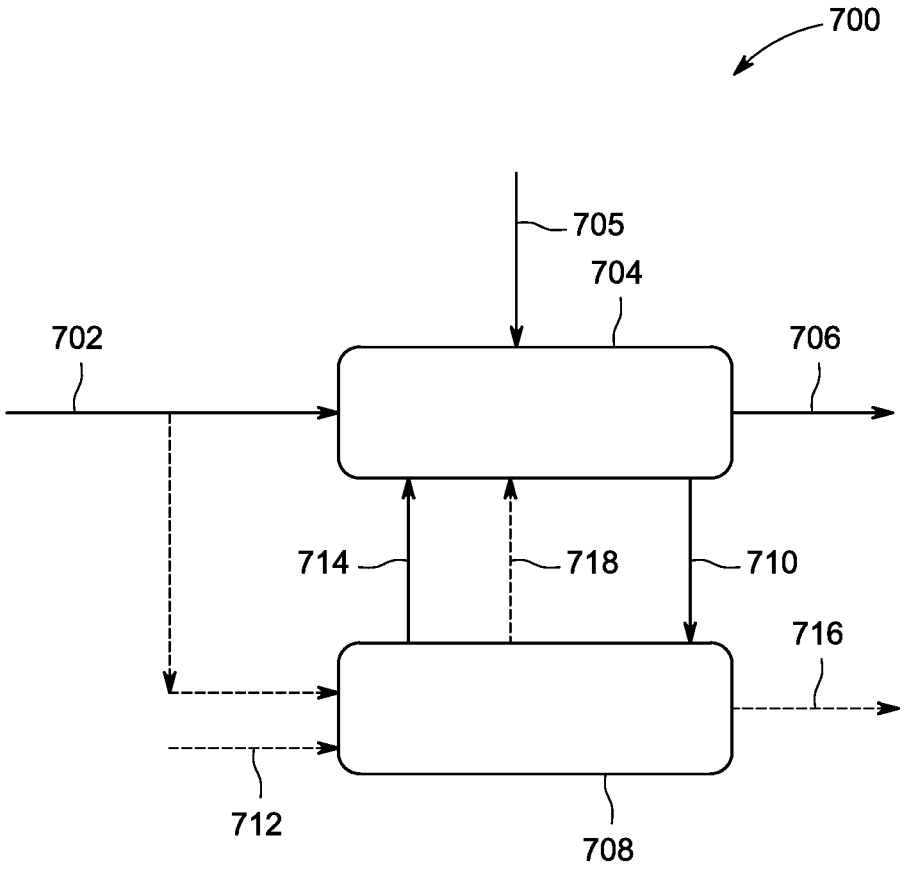
FIG. 7 is a diagram of an embodiment of an LNG and electric power coproduction facility.

Other fluids within an LNG production facility can also be used to provide heat for HHC distillation. For example, heat that can be produced during generation of electric power can be used for HHC distillation, as illustrated in FIG. 7. FIG. 7 shows a diagram of an embodiment of an LNG and electric power coproduction facility 700. The coproduction facility 700 can use a single NG feedstock 702 to produce LNG and electrical power. In the illustrated example, NG feedstock 702 can be directed to an LNG production facility 704 to be compressed and condensed to form LNG 706. The LNG production facility can receive electric power 705 from an external power source such as a local power grid, or a battery bank. The electric power 705 can be used, e.g., to power electric-motor driven compressors that can be used to compress a MR within a refrigeration process that cools the incoming NG feedstock 702 to produce the LNG 706. The electric power 705 can also be used to power compressors that compress NG feedstock prior to liquefaction. Additionally, or alternatively, the electric power 705 can be used to power other electric power consuming devices within the LNG production facility 702. The process of condensing NG feedstock 702 to form LNG 706 can generally be similar to that described with respect to FIG. 1. Once the LNG has been produced, the pressure of the LNG can typically be reduced by passing it through a series of let-down valves (flash valves), and flash vessels, and into a low pressure storage tank. The process of reducing the pressure of the LNG can create some flash gas. Additionally, heat can leak into the low pressure storage vessel and it can boil some of the LNG, thus forming boil-off gas (BOG). The flash gas and BOG (fuel vapor) 710 can be collected and sent to a power generation facility 708 to be used as fuel, while the LNG 706 can be stored, consumed, or distributed as desired.

The power generation facility 708 can use NG feedstock 702, fuel vapor 710, or other fuels 712, e.g., petrol, diesel, propane, or kerosene, to create electric power. For example, NG feedstock 202, fuel vapor 210, and other fuels 212, can be used as fuel in gas turbines such as simple cycle gas turbines (SCGT) and combined cycle gas turbines (CCGT), as well as steam boilers and steam turbines, to produce mechanical power. A portion of the mechanical power can be used to drive an electric generator to generate electric power. In the illustrated example, some electric power 714 that can be generated in the power generation facility 708 can be delivered to the LNG production facility 704 to supplement or replace the electric power 705 from the external source. Another quantity of electric power 716 can be, for example, stored in batteries, diverted to a local power grid, or consumed elsewhere. In some embodiments, NG feedstock 702 is the only fuel that is used for the production of LNG 706 and electric power 714, 716.

During electric power generation, a significant amount of waste heat can be produced. As shown in FIG. 7, some heat 718 can be diverted to the LNG production facility 704. The waste heat 718 can be captured in, e.g., steam, oil, flue gas, NG, or air to be delivered to the LNG production facility 704. The waste heat 718 can be used as a heat source for HHC distillation. Alternatively, the waste heat can be used in a reboiler of an acid gas removal system, which can be used to remove $CO_2$ and/or $H_2S$ from natural gas feedstock, or a dehydration dryer system, which can be used to remove $H_2O$ from natural gas feedstock.

The heat sources described herein for use within HHC distillation system can reduce environmental emissions by eliminating the need to fire fuel to provide heat to HHC liquid for distillation in a HHC distillation system. Although MR is used in the embodiments described herein, alternate refrigerants can be used within refrigeration systems and within the methods, systems, and devices described herein. Examples of alternate refrigerants include ammonia, propane, nitrogen, methane, ethane, ethylene, or other industrial gas or hydrocarbon based refrigerants.

Exemplary technical effects of the methods, systems, and devices described herein include, by way of non-limiting example, the ability to increase the efficiency of HHC distillation, and simplify HHC distillation systems within LNG production facilities. Exemplary technical effects also include the ability to distill HHC liquid using air, natural gas, MR, or a heated fluid from a power generation facility, as a heat source. The aforementioned methods, systems, and devices, can function to increase the efficiency of HHC distillation and LNG production, simplify HHC distillation systems within an LNG production facility, and reduce environmental emissions associated with LNG production and HHC distillation.

One skilled in the art will appreciate further features and advantages of the subject matter described herein based on the above-described embodiments. Accordingly, the present application is not to be limited specifically by what has been particularly shown and described.

What is claimed is:

1. A system for producing liquefied natural gas (LNG) and separating heavy hydrocarbon components, comprising:

a refrigerant supply system including a first valve configured to supply a refrigerant fluid to accept heat from a natural gas feedstock;

a compression system, including at least one compressor configured to receive and compress the refrigerant fluid;

a condenser coupled to the compression system, the condenser configured to output condensed refrigerant fluid via a second valve; and a distillation column coupled to the condenser and configured to receive the condensed refrigerant fluid via the second valve, the distillation column having a first heat exchanger connected to a second heat exchanger via at least one downcomer and at least one riser, wherein the at least one downcomer and the at least one riser include a valve to control heat transferred to a liquid containing heavy hydrocarbon components, the first heat exchanger and the second heat exchanger configured with heat pipes to aid transferring heat to the liquid containing heavy hydrocarbon components such that the liquid boils to form vapor thereby allowing the heavy hydrocarbon components to be separated and collected, the heat being transferred from a heated fluid comprising at least a portion of the natural gas feedstock, wherein the heat is transferred from the heated fluid by natural convection or forced convection and the heat being transferred from the heated fluid is delivered to the first heat exchanger from the second heat exchanger.

2. The system of claim 1, wherein the first heat exchanger is a reboiler.

3. A method for separating heavy hydrocarbon components, comprising:

delivering a fluid from a refrigerant supply system to a condenser coupled to the refrigerant supply system and condensing the fluid;

delivering the condensed fluid to a first heat exchanger configured within a distillation column that contains a liquid containing heavy hydrocarbon components;

providing the liquid to the first heat exchanger via a downcomer coupling the heat exchanger to the distillation column, the downcomer including a control valve;

transferring heat from the fluid to the liquid such that the liquid boils to form a vapor containing heavy hydrocarbon components, wherein heat is transferred to the liquid at a rate determined by a setting of the downcomer control valve and/or a riser control valve included in a riser configured to provide the vapor to the distillation column from the heat exchanger, the riser coupling the heat exchanger and the distillation column;

extracting heat from the vapor such that desired heavy hydrocarbon components condense to form a distilled heavy hydrocarbon liquid; and collecting the condensed distilled heavy hydrocarbon liquid.

4. The method of claim 3, wherein the fluid is ambient air.

5. The method of claim 4, wherein the heat is transferred from the air via natural convection.

6. The method of claim 4, wherein the heat is transferred from the air via forced convection.

7. The method of claim 3, wherein the fluid is natural gas (NG) feedstock that is used to produce LNG.

8. The method of claim 3, wherein the heat is transferred from air in the distillation column to the fluid via a second heat exchanger that is thermally coupled to the first heat exchanger.

9. The method of claim 8, wherein the heat is transferred from the air via natural convection.

10. The method of claim 8, wherein the heat is transferred from the air via forced convection.

11. The method of claim 3, wherein the heat is transferred from a NG feedstock to the fluid via a second heat exchanger that is thermally coupled to the first heat exchanger.

12. The method of claim 3, wherein the heat is transferred from a refrigerant to the fluid, the refrigerant having received heat from an NG feedstock.

13. The method of claim 3, wherein a refrigerant is heated during compression and heat is transferred from the refrigerant to the fluid after compression.

* * * * *